US007241255B2

(12) United States Patent
Onishi

(10) Patent No.: US 7,241,255 B2
(45) Date of Patent: Jul. 10, 2007

(54) METHOD AND APPARATUS FOR ATTACHING A HOOK-AND-LOOP FASTENER TO A CARTON WITH A LID

(75) Inventor: Toshiyuki Onishi, Yawata (JP)

(73) Assignee: Kyoto Seisakusho Co., Ltd., Kyoto-shi (JP)

( * ) Notice: Subject to any disclaimer, the term of this patent is extended or adjusted under 35 U.S.C. 154(b) by 14 days.

(21) Appl. No.: 11/187,485

(22) Filed: Jul. 22, 2005

(65) Prior Publication Data

US 2007/0021284 A1 Jan. 25, 2007

(51) Int. Cl.
*B31B 1/90* (2006.01)

(52) U.S. Cl. ..... 493/102; 493/114; 493/121; 493/214

(58) Field of Classification Search ..... 493/102, 493/109, 114–117, 121, 214; 53/133.3, 133.4, 53/135.2, 136.4; 206/308.1, 309–313
See application file for complete search history.

(56) References Cited

U.S. PATENT DOCUMENTS 5,390,474 A * 2/1995 Goggins ..... 53/467
5,772,018 A * 6/1998 Walch ..... 206/308.1
5,845,772 A * 12/1998 Cieplak ..... 206/308.3
5,961,761 A * 10/1999 Heindel et al. ..... 156/163
6,212,741 B1 * 4/2001 Cahill ..... 24/298
6,354,065 B1 * 3/2002 Horton et al. ..... 53/564
6,458,115 B1 * 10/2002 Lindqvist et al. ..... 604/391
6,892,878 B2 5/2005 Hegarty et al.
2006/0162288 A1 * 7/2006 Kingsford et al. ..... 53/396
2006/0162289 A1 * 7/2006 Shepard et al. ..... 53/412

* cited by examiner

*Primary Examiner*—Hemant M. Desai
(74) *Attorney, Agent, or Firm*—W. F. Fasse; W. G. Fasse

(57) ABSTRACT

A pair of hook-and-loop fasteners are attached onto a carton for securing a lid thereof. First fasteners are provided spaced apart along a first exfoliation sheet. Second fasteners adapted to mate and engage with the first fasteners are provided spaced apart along a second exfoliation sheet. The first sheet is deflected over a first knife edge to peel-off a first fastener and engage it onto a second fastener to form a fastener pair. The second sheet is deflected over a second knife edge to peel-off the second fastener of the pair from the second sheet and adhesively stick the fastener pair onto the carton.

9 Claims, 4 Drawing Sheets

METHOD AND APPARATUS FOR ATTACHING A HOOK-AND-LOOP FASTENER TO A CARTON WITH A LID

BACKGROUND OF THE INVENTION

The present invention relates to a method or an apparatus for attaching a hook-and-loop fastener to a carton with an openable and closable lid to maintain a closing state of the lid relative to a carton body.

U.S. Pat. No. 6,892,878 shows a disk case for housing a photoelectromagnetic disk such as a CD (i.e. compact disk) or DVD (i.e. digital video disk). The disk case is typically comprised of a disk loading portion for loading a photoelectromagnetic disk and a sheet loading portion for loading a description sheet, which are openably and closably connected to each other via a hinge.

After a photoelectromagnetic disk and a description sheet are loaded into the disk case, the disk case is closed. Such a disk case is sometimes housed in a carton. Also, a carton with a lid has recently been used to house a disk case.

In such a carton with a lid, a closing state of a lid relative to a carton body needs to be maintained at the time of closure of the lid and also the lid needs to be easily disengaged from the carton body at the time of opening of the lid. Therefore, such a carton with a lid requires an engaging and disengaging mechanism for opening and closing a lid.

An object of the present invention is to provide a method and an apparatus for easily attaching a hook-and-loop fastener as an engageable and disengageable means on a carton with a lid to maintain a closing state of the lid relative to a carton body.

SUMMARY OF THE INVENTION

The present invention is directed to a method or apparatus for attaching a hook-and-loop fastener on a carton to maintain a closing state of a lid relative to a carton body.

A method for attaching a hook-and-loop fastener according to the present invention has application to a carton with an openable and closable lid. The method includes the steps comprising:

(i) preparing a first band-shaped exfoliation sheet on which a plurality of first hook-and-loop fasteners spaced apart at a first distance are attached via adhesive back surfaces thereof;

(ii) preparing a second band-shaped exfoliation sheet on which a plurality of second hook-and-loop fasteners spaced apart at a second distance equal to the first distance and engageable with and disengageable from the first hook-and-loop fasteners are attached via adhesive back surfaces of the second hook-and-loop fasteners;

(iii) feeding the first and second exfoliation sheet with an engaging front surface of the first hook-and-loop fastener on the first exfoliation sheet oppositely disposed to an engaging front surface of the second hook-and-loop fastener on the second exfoliation sheet;

(iv) bending the first exfoliation sheet in a knife-edged shape toward the back surface side thereof at a first downstream end of the feeding direction of the first exfoliation sheet to exfoliate the first hook-and-loop fastener from the first exfoliation sheet at the first downstream end thereof, and engaging the exfoliated first hook-and-loop fastener with the corresponding second hook-and-loop fastener on the second exfoliating sheet through the engaging front surfaces of the first and second hook-and-loop fastener;

(v) bending the second exfoliation sheet in a knife-edged shape toward the back surface side thereof at a second downstream end of the feeding direction of the second exfoliation sheet, which is further downstream than the first downstream end of the first exfoliation sheet, to exfoliate the first and second hook-and-loop fastener from the second exfoliation sheet at the second downstream end thereof, and attaching the exfoliated first and second hook-and-loop fastener on a front surface of the carton body or a back surface of the lid through the adhesive back surface of the second hook-and-loop fastener; and (vi) closing the lid of the carton so that the adhesive back surface of the first hook-and-loop fastener can be attached on the rear surface of the lid or the front surface of the carton body.

An apparatus for attaching a hook-and-loop fastener according to the present invention has application to a carton with an openable and closable lid. The apparatus comprising:

(i) a first band-shaped exfoliation sheet on which a plurality of first hook-and-loop fasteners spaced apart at a first distance are attached via adhesive back surfaces;

(ii) a second band-shaped exfoliation sheet on which a plurality of second hook-and-loop fasteners spaced apart at a second distance equal to the first distance and engageable with and disengageable from the first hook-and-loop fasteners are attached via adhesive back surfaces;

(iii) a first and second feeding means for feeding the first and second exfoliation sheet respectively with an engaging front surface of the first hook-and-loop fastener on the first exfoliation sheet oppositely disposed to an engaging front surface of the second hook-and-loop fastener on the second exfoliation sheet;

(iv) a first knife-edge portion for bending the first exfoliation sheet in a knife-edged shape toward the back surface side thereof at a first downstream end of the feeding direction of the first exfoliation sheet to exfoliate the first hook-and-loop fastener from the first exfoliation sheet at the first downstream end thereof, and engaging the exfoliated first hook-and-loop fastener with the corresponding second hook-and-loop fastener on the second exfoliating sheet through the engaging front surfaces of the first and second hook-and-loop fastener;

(v) a second knife-edge portion for bending the second exfoliation sheet in a knife-edged shape toward the back surface side thereof at a second downstream end of the feeding direction of the second exfoliation sheet, which is further downstream than the first downstream end of the first exfoliation sheet, to exfoliate the first and second hook-and-loop fastener from the second exfoliation sheet at the second downstream end thereof, and attaching the exfoliated first and second hook-and-loop fastener on a front surface of the carton body or a back surface of the lid through the adhesive back surface of the second hook-and-loop fastener; and (vi) a closure means for closing the lid of the carton so that the adhesive back surface of the first hook-and-loop fastener can be attached on the rear surface of the lid or the front surface of the carton body.

According to the present invention, when the lid of the carton closes after engaged and integrated first and second hook-and-loop fasteners have been attached to the carton body (or lid) through the adhesive back surface of the second hook-and-loop fastener, the adhesive back surface of the first hook-and-loop fastener is attached on the lid or the carton body. Therefore, when the lid opens next time, disengagement of the first hook-and-loop fastener from the second hook-and-loop fastener occurs, and attachment of the first hook-and-loop fastener to the lid (or carton body) through the adhesive back surface of the first hook-and-loop fastener is maintained. In this case, a pair of corresponding first and second hook-and-loop fasteners can be attached through only one attaching operation, thereby simplifying the operation of attaching a pair of corresponding hook-and-loop fasteners.

To the contrary, in the case where only one of a pair of corresponding first and second hook-and-loop fasteners is attached to a carton body (or lid), the other hook-and-loop fastener should be attached to the lid (or carton body), thus requiring twice attaching operations. Moreover, in this case, when attaching the other hook-and-loop fastener, an accurate positioning of the other hook-and-loop fastener relative to the one hook-and-loop fastener is required.

As above-mentioned, according to the present invention, only one attaching operation is needed, and laborious positioning operation is not required.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
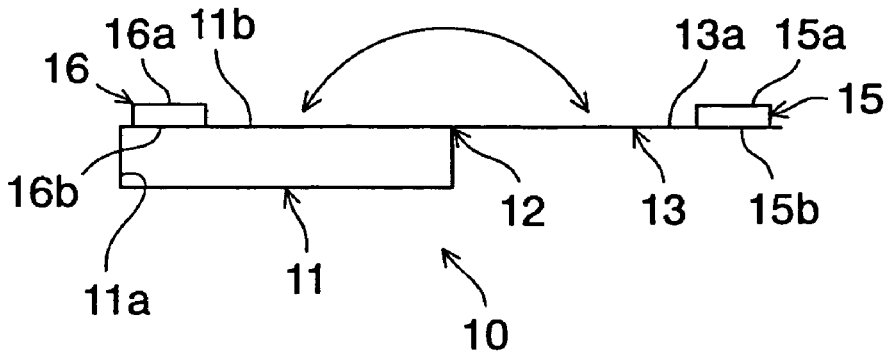
FIG. 1 is a side view of a carton to which a method for attaching a hook-and-loop fastener according to the present invention is applied, showing the opening state of the lid.
Figure 1A:
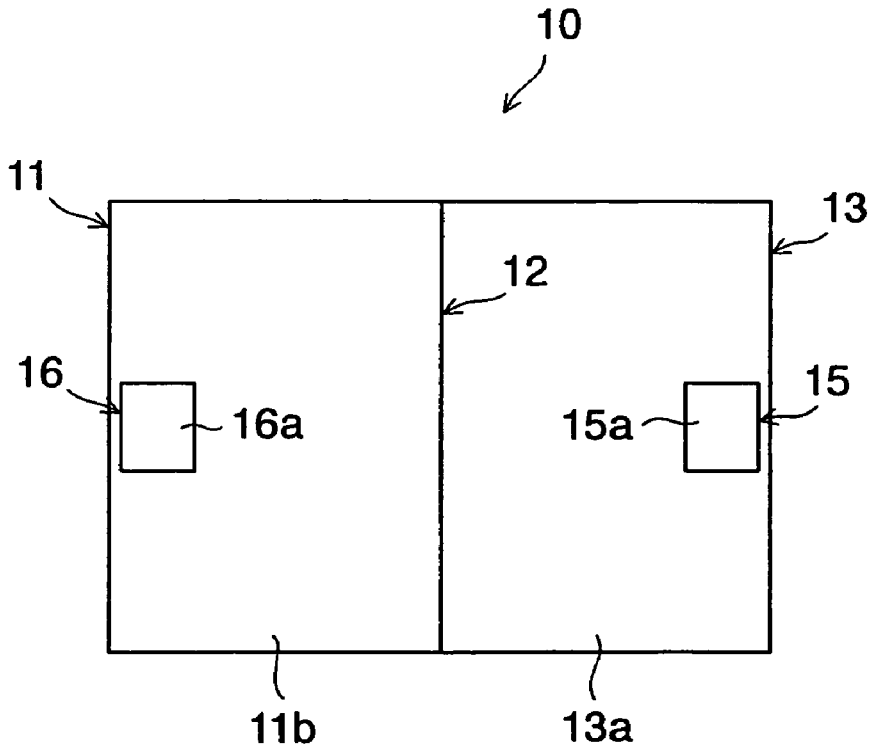
FIG. 1A is a top plan view of the carton of FIG. 1.

Referring now to the drawings, FIGS. 1 and 1A show an example of a carton to which a method of attaching a hook-and-loop fastener according to the present invention is applied. Here, a carton for housing a disk case into which a photoelectromagnetic disk such as a CD or DVD is loaded will be explained by way of an example.

A carton 10 is formed of a box-shaped carton body 11, a hinge 12 formed on one side edge portion of the carton body 11 and a lid 13 rotatably supported around the hinge 12. In this example, the carton body 11 is tubular in shape and has a through hole 11*a* of a square cross sectional shape extending into and out of the page.

A first hook-and-loop fastener 15 is attached on the rear surface 13*a* of the lid 13. The fastener 15 is located at a position in the vicinity of an end portion of the lid 13. The fastener 15 has an engagement surface on its front surface 15*a* and an adhesive surface on its rear surface 15*b*. The fastener 15 is attached on the rear surface 13*a* of the lid 13 via the rear adhesive surface 15*b*.

A second hook-and-loop fastener 16 is attached on the front surface 11*b* of the carton body 11. The fastener 16 is located at a position in the vicinity of an end portion of the carton body 11. The position of the second hook-and-loop fastener 16 on the carton body 11 accurately coincides with the position of the first hook-and-loop fastener 15 when the lid 13 is closed and overlapped with the carton body 11.

The fastener 16 has an engagement surface on its front surface 16*a* and an adhesive surface on its rear surface 16*b*. The front surface 16*a* of the second hook-and-loop fastener 16 is adapted to releasably engage with the front surface 15*a* of the first hook-and-loop fastener 15. That is, one of the hook-and-loop fasteners 15, 16 is, for example, a hook-type fastener and the other of the hook-and-loop fasteners 15, 16 is, for example, a loop-type fastener. The fastener 16 is attached on the front surface 11*b* of the carton body 11 via the rear adhesive surface 16*b*. Additionally, in FIG. 1 and the following drawings, a hook-and-loop fastener is exaggerated for illustration purposes.

Then, an apparatus for attaching a hook-and-loop fastener according to an embodiment of the present invention will be explained using FIG. 2.

Figure 2:
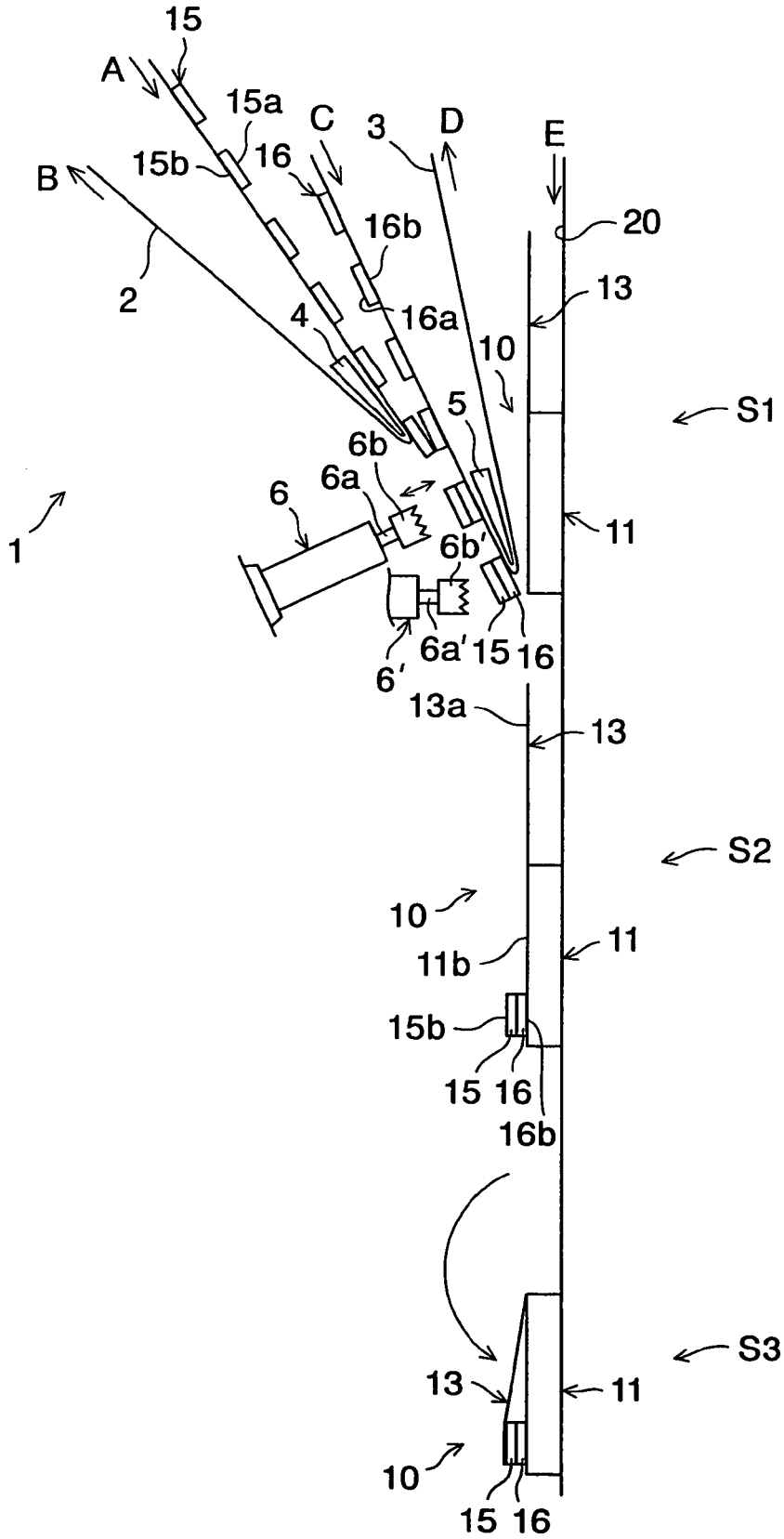
FIG. 2 illustrates a schematic showing a method and apparatus for attaching a hook-and-loop fastener according to an embodiment of the present invention.

As shown in FIG. 2, an apparatus 1 for attaching a hook-and-loop fastener 1 includes a first band-shaped exfoliation sheet 2 and a second band-shaped exfoliation sheet 3 provided under the first band-shaped exfoliation sheet 2. The first band-shaped exfoliation sheet 2 has a plurality of first hook-and-loop fasteners 15 attached thereon. The first hook-and-loop fasteners 15 are spaced apart at a first distance and attached on the first exfoliation sheet 2 via adhesive back surfaces 15*b*. Similarly, the second band-shaped exfoliation sheet 3 has a plurality of second hook-and-loop fasteners 16 attached thereon. The second hook-and-loop fasteners 16 are spaced apart at a second distance equal to the first distance and attached on the second exfoliation sheet 3 via adhesive back surfaces 16*b*.

The first exfoliation sheet 2 is fed by a feeding roller (not shown) in the direction shown by an arrow mark A, folded back toward a backside surface in an acute angle at a downstream end thereof, fed in the direction shown by an arrow mark B and wound around a winding roller (not shown). Likewise, the second exfoliation sheet 3 is fed by a feeding roller (not shown) in the direction shown by an arrow mark C, folded back toward a backside surface in an acute angle at a downstream end thereof, fed in the direction shown by an arrow mark D and wound around a winding roller (not shown).

Also, the first and second band-shaped exfoliation sheet 2, 3 are fed at a synchronous speed with the front engagement surface 15*a* of the first hook-and-loop fastener 15 on the first exfoliation sheet 2 disposed opposite the front engagement surface 16*a* of the second hook-and-loop fastener 16 on the second exfoliation sheet 3. The position of the downstream end of the second exfoliation sheet 3 is further downstream than the position of the downstream end of the first exfoliation sheet 2.

A first knife edge 4 is provided at a downstream end of the first exfoliation sheet 2. The first knife edge 4 has a pointed distal end portion with an acute angle and disposed on the backside of the first exfoliation sheet 2. The first exfoliation sheet 2 is bent and folded back in a knife-edged shape toward the backside surface thereof along the pointed distal end portion of the first knife edge 4 at the downstream end. Similarly, a second knife edge 5 is provided at a downstream end of the second exfoliation sheet 3. The second knife edge 5 has a pointed distal end portion with an acute angle and disposed on the backside of the second exfoliation sheet 3. The second exfoliation sheet 3 is bent and folded back in a knife-edged shape toward the backside surface thereof along the pointed distal end portion of the second knife edge 5 at the downstream end.

Cylinders 6, 6' are provided over the second exfoliation sheet 3 between the downstream end of the first exfoliation sheet 2 and the downstream end of the second exfoliation sheet 3. The cylinder 6, 6' has a contact block 16*b*, 6*b'*, respectively, fixed at the distal end of a piston rod 16*a*, 6*a'*. The piston rod 6*a* extends perpendicular to the second exfoliation sheet 3 and the piston rod 6*a'* extends perpendicular to the conveyor 20.

Then, we will explain a method for attaching a hook-and-loop fastener using the apparatus 1.

Driving of feeding rollers (not shown) causes a feed of the first and second exfoliation sheet 2, 3 in the direction shown by the arrow mark A, C, respectively. On the other hand, a conveyor 20 carries a carton 10 with the lid 13 open in the direction shown by the arrow mark E, on which a hook-and-loop faster will be attached.

When the first hook-and-loop fastener 15 on the first exfoliation sheet 2 is transferred to the downstream end of the feed direction of the first exfoliation sheet 2, the pointed distal end portion of the first knife edge 4 bends the first exfoliation sheet 2 and folds it back toward the rear surface side thereof in a knife-edged shape, thereby causing the first hook-and-loop fastener 15 to be exfoliated or peeled of f from the first exfoliation sheet 2. On the other hand, the second hook-and-loop fastener 16 on the second exfoliation sheet 3 is transferred to the position under the downstream end of the first exfoliation sheet 2. Therefore, the first hook-and-loop fastener 15 stripped from the first exfoliation sheet 2 contacts and engages with the engagement surface 16*a* of the second hook-and-loop fastener 16 on the second exfoliation sheet 3 via the engagement surface 15*a* of the first hook-and-loop fastener 15. In such a manner, there are not any first hook-and-loop fasteners 15 remained on the first exfoliation sheet 2 that has been folded back at the downstream end. Also, the first and second hook-and-loop fasteners 15, 16 that have been engaged with each other are attached on the second exfoliation sheet 3 on the downstream side from the downstream end of the first exfoliation sheet 2.

When the first and second hook-and-loop fastener 15, 16 on the second exfoliation sheet 3 is transferred to the downstream side of the downstream end of the first exfoliation sheet 2, the piston rod 6*a* of the piston 6 protrudes to push the first and second hook-and-loop fastener 15, 16 through the contact block 6*b* so that the first and second hook-and loop fastener 15, 16 can be securely engaged. In addition, the cylinder 6 may be omitted for cost reduction purposes.

Then, when the first and second hook-and-loop fastener 15, 16 on the second exfoliation sheet 3 is transferred to the downstream end of feed direction of the second exfoliation sheet 3, the pointed distal end portion of the second knife edge 5 bends the second exfoliation sheet 3 and folds it back toward the rear surface side thereof in a knife-edged shape, thereby causing the first and second hook-and-loop fastener 15, 16 to be exfoliated or peeled off from the second exfoliation sheet 3. On the other hand, a carton 10 is transferred to Station S1 under the downstream end of the second exfoliation sheet 3. Therefore, the first and second hook-and-loop fastener 15, 16 stripped from the second exfoliation sheet 3 is attached on the front surface 11*b* of the carton body 11 via the rear adhesive surface 16*b* of the second hook-and-loop fastener 16 (see Station S2).

The piston rod 6*a'* of the piston 6' protrudes to push the first and second hook-and-loop fastener 15, 16 through the contact block 6*b'* so that the second hook-and-loop fastener 16 can be securely attached on the carton body 11 via the rear adhesive surface 16*b*. In addition, the cylinder 6' may be omitted for cost reduction purposes.

Next, while the conveyor 20 transfers the carton 10 from Station S2 to Station S3, a closure means (hereinafter explained) closes the lid 13 of the carton 10.

A lid closure operation by the closure means will be explained using FIGS. 3A to 3D.

Figure 3A:
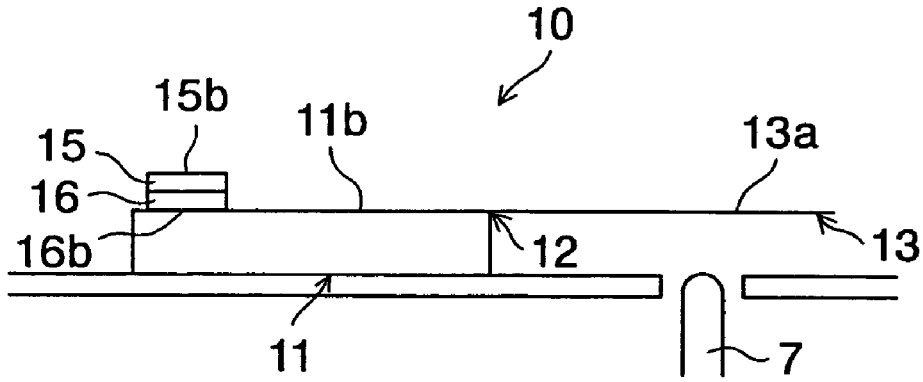
FIGS. 3A to 3D show the closing operation of the lid of the carton.
Figure 3B:
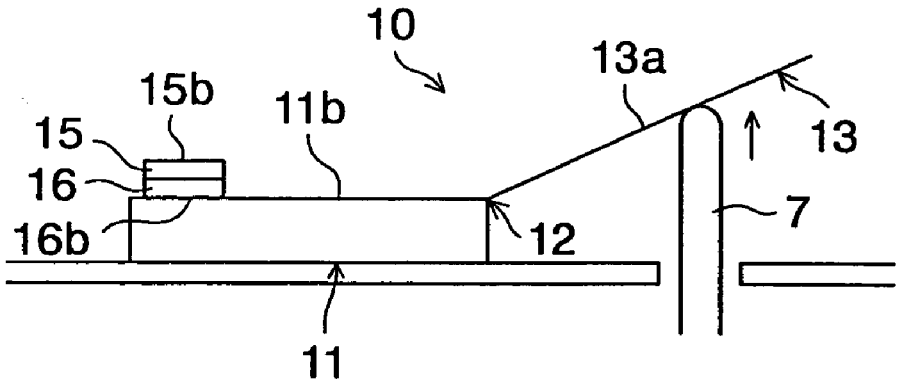
Figure 3C:
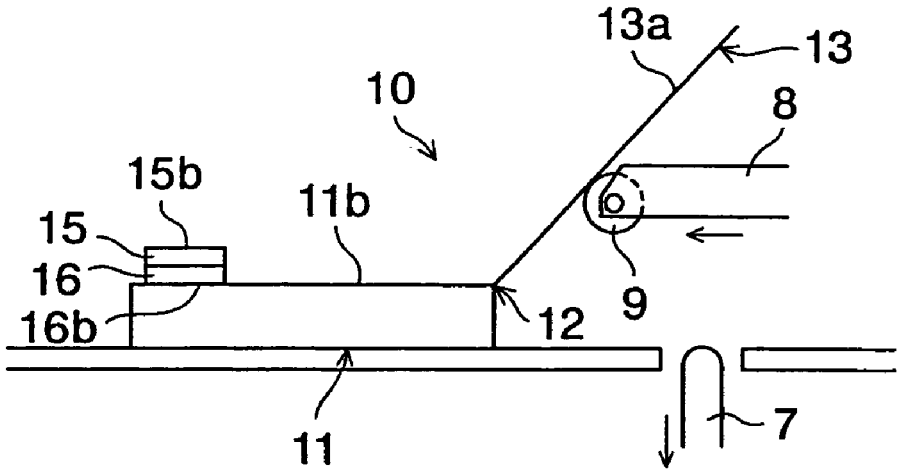
Figure 3D:
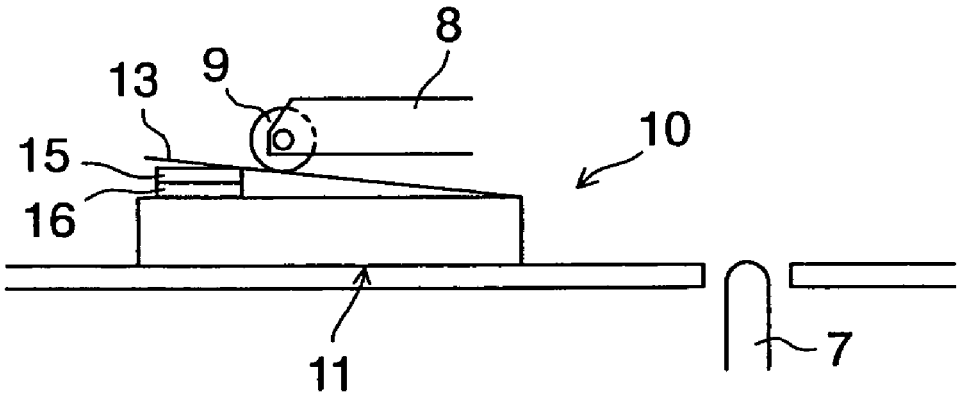

As shown in FIG. 3A, an upwardly and downwardly movable rod 7 is provided under the lid 13 of the carton 10. When the carton 10 stays at Station S2, the rod 7 moves upwardly to push the lid 13 up, as shown in FIG. 3B. As the lid 13 is lifted up to the inclined state shown in FIG. 3C, an arm 8 with a rotatable roller 9 travels toward and contacts the lid 13 via the rotatable roller 9 and the rod 7 moves downwardly. In such a state, the arm 8 moves toward the carton body 11 to close the lid 13, as shown in FIG. 3D. When the lid 13 is closed, the rear surface 13*a* of the lid 13 contacts the rear adhesive surface 15*b* of the first hook-and-loop fastener 15 and the first hook-and-loop fastener 15 is attached on the lid 13 via the rear adhesive surface 15*b*.

Thereafter, when the lid 13 of the carton 10 opens, the engagement surfaces 15*a*, 16*a* of the first and second hook-and-loop fastener 15, 16 disengage. As a result, only the second hook-and-loop fastener 16 remains on the front surface 11*b* of the carton body 11 and the first hook-and-loop fastener 15 is attached on the rear surface 13*a* of the lid 13, as shown in FIG. 1.

In this case, a pair of corresponding first and second hook-and-loop fasteners 15, 16 can be attached on the carton 10 by only one attaching operation, which simplifies the attaching operation of the pair of corresponding hook-and-loop fasteners. Moreover, in this case, laborious positioning operation of the pair of corresponding first and second hook-and-loop fasteners 15, 16 is not required.

In the above-mentioned embodiment, an example was shown where the first and second hook-and-loop fastener 15, 16 stripped from the second exfoliation sheet 3 is attached on the front surface 11*b* of the carton body 11 of the carton 10, but the present invention is not limited to such an example. The first and second hook-and-loop fastener 15, 16 stripped from the second exfoliation sheet 3 may be attached on the rear surface 13*a* of the lid 13 of the carton 10.

In this case, when the lid 13 is closed, the engagement surface 15*b* of the first hook-and-loop fastener 15 contacts the front surface 11*b* of the carton body 11 and the first hook-and-loop fastener 15 is attached on the front surface 11*b* of the carton body 11. Therefore, when the lid 13 opens next time, the engagement surfaces 15*a*, 16*a* of the first and second hook-and-loop fastener 15, 16 disengage. As a result, only the second hook-and-loop fastener 16 remains on the lid 13 of the carton 10 and the first hook-and-loop fastener 15 is attached on the carton body 11.

In this case, as with the above-mentioned embodiment, a pair of corresponding first and second hook-and-loop fasteners 15, 16 can be attached on the carton 10 by only one attaching operation, which simplifies the attaching operation of the pair of hook-and-loop fasteners. Moreover, in this case, laborious positioning operation of the pair of corresponding first and second hook-and-loop fasteners 15, 16 is not required.

In the above-mentioned embodiments, a carton for housing a disk case in use for a photoelectromagnetic disk such as a CD or DVD was shown by way of example of a carton 10, but the present invention can be applied to a carton other than the carton 10.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A method for attaching a pair of corresponding hook-and-loop fasteners on a carton including a carton body and an openable and closeable lid, each of the pair of hook-and-loop fasteners having an adhesive back surface and an engaging front surface adapted to engage with each other to maintain a closure state of the lid relative to the carton body, the method comprising:

a) preparing a first band-shaped exfoliation sheet on which a plurality of first hook-and-loop fasteners spaced apart at a first distance are attached via the adhesive back surfaces thereof;

b) preparing a second band-shaped exfoliation sheet on which a plurality of second hook-and-loop fasteners spaced apart at a second distance and engageable with and disengageable from the first hook-and-loop fasteners are attached via the adhesive back surfaces of the second hook-and-loop fasteners;

c) feeding the first and second exfoliation sheets with the engaging front surfaces of the first hook-and-loop fasteners on the first exfoliation sheet oppositely disposed to the engaging front surfaces of the second hook-and-loop fasteners on the second exfoliation sheet;

d) bending the first exfoliation sheet in a knife-edged shape toward a back surface side thereof at a first downstream end of a feeding direction of the first exfoliation sheet to exfoliate the first hook-and-loop fasteners from the first exfoliation sheet at the first downstream end thereof, and engaging the exfoliated first, hook-and-loop fastener with the corresponding second hook-and-loop fastener on the second exfoliation sheet through the engaging front surfaces of the first and second hook-and-loop fasteners;

e) bending the second exfoliation sheet in a second knife-edged shape toward a back surface side thereof at a second downstream end of a feeding direction of the second exfoliation sheet, which is further downstream than the first downstream end of the feeding direction of the first exfoliation sheet, to exfoliate the first and second hook-and-loop fasteners from the second exfoliation sheet at the second downstream end thereof, and attaching the exfoliated first and second hook-and-loop fasteners through the adhesive back surface of the second hook-and-loop fastener on a front surface of the carton body or a back surface of the lid of the carton in an open state of the lid relative to the carton body; and f) closing the lid of the carton so that the adhesive back surface of the first hook-and-loop fastener can be attached on the back surface of the lid or the front surface of the carton body.

2. The method of claim 1, wherein the carton is in use for housing a disk case for loading a photoelectromagnetic disk.

3. An apparatus for attaching a pair of corresponding hook-and-loop fasteners on a carton including a carton body and an openable and closeable lid, each of the pair of hook-and-loop fasteners having an adhesive back surface and an engaging front surface adapted to engage with each other to maintain a closure state of the lid relative to the carton body, the apparatus comprising:

a) a first band-shaped exfoliation sheet on which a plurality of first hook-and-loop fasteners spaced apart at a first distance are attached via the adhesive back surfaces;

b) a second band-shaped exfoliation sheet on which a plurality of second hook-and-loop fasteners spaced apart at a second distance and engageable with and disengageable from the first hook-and-loop fasteners are attached via the adhesive back surfaces of the second hook-and-loop fasteners;

c) first and second feeding means for feeding the first and second exfoliation sheets respectively with the engaging front surfaces of the first hook-and-loop fasteners on the first exfoliation sheet oppositely disposed to the engaging front surfaces of the second hook-and-loop fasteners on the second exfoliation sheet;

d) a first knife-edge portion for bending the first exfoliation sheet in a knife-edged shade toward a back surface side thereof at a first downstream end of a feeding direction of the first exfoliation sheet to exfoliate the first hook-and-loop fasteners from the first exfoliation sheet at the first downstream end thereof, and engaging the exfoliated first hook-and-loop fastener with the corresponding second hook-and-loop fastener on the second exfoliation sheet through the engaging front surfaces of the first and second hook-and-loop fasteners;

e) a second knife-edge portion for bending the second exfoliation sheet in a knife-edged shape toward a back surface side thereof at a second downstream end of a feeding direction of the second exfoliation sheet, which is further downstream than the first downstream end of the feeding direction of the first exfoliation sheet, to exfoliate the first and second hook-and-loop fasteners from the second exfoliation sheet at the second downstream end thereof, and attaching the exfoliated first and second hook-and-loop fasteners through the adhesive back surface of the second hook-and-loop fastener on a front surface of the carton body or a back surface of the lid of the carton in an open state of the lid relative to the carton body; and f) a closure means for closing the lid of the carton so that the adhesive back surface of the first hook-and-loop fastener can be attached on the back surface of the lid or the front surface of the carton body.

4. The apparatus of claim 3, wherein the carton is in use for housing a disk case for loading a photoelectroinagnetic disk.

5. A method of attaching a hook-and loop fastener pair to a carton, wherein said carton includes a carton body and a lid that is movable relative to said carton body, said hook-and-loop fastener pair includes a first fastener and a second fastener that each respectively have a respective adhesive back surface and a respective engaging front surface, said engaging front surfaces of said first and second fasteners are adapted to be releasably matingly engaged with one another by a hook-and-loop engagement, said method comprising the steps:

a) providing said carton with said lid open relative to said carton body;

b) providing said first fastener with said adhesive back surface thereof adhered onto a first exfoliation sheet;

c) providing said second fastener with said adhesive back surface thereof adhered onto a second exfoliation sheet and with said engaging front surface thereof facing toward and separated from said engaging front surface of said first fastener;

d) advancing and deflecting said first exfoliation sheet over a first deflecting edge that is so positioned relative to said second exfoliation sheet so that said adhesive back surface of said first fastener is exfoliated from said first exfoliation sheet and said engaging front surface of said first fastener is engaged onto said engaging front surface of said second fastener to form said hook-and-loop fastener pair of said first and second fasteners engaged with one another;

e) advancing and deflecting said second exfoliation sheet over a second deflecting edge so that said adhesive back surface of said second fastener is exfoliated from said second exfoliation sheet to thereby release said hook-and-loop fastener pair from said second exfoliation sheet;

f) adhering said adhesive back surface of one of said fasteners of said hook-and-loop fastener pair onto one of said carton body or said lid when said lid is open relative to said carton body;

g) closing said lid relative to said carton body, to thereby adhere said adhesive back surface of the other of said fasteners of said hook-and-loop fastener pair onto the other of said carton body or said lid when said lid closes relative to said carton body.

6. The method according to claim 5, wherein said step e) is carried out after completing said step d).

7. The method according to claim 5, wherein said step f) involves adhering said adhesive back surface of said second fastener onto said carton body or said lid.

8. The method according to claim 7, wherein said step f) involves adhering said adhesive back surface of said second fastener onto said carton body.

9. The method according to claim 5, wherein said step f) results from the performance of said step e).

* * * * *

UNITED STATES PATENT AND TRADEMARK OFFICE

CERTIFICATE OF CORRECTION

PATENT NO. : 7,241,255 B2
APPLICATION NO. : 11/187485
DATED : July 10, 2007
INVENTOR(S) : Onishi It is certified that error appears in the above-identified patent and that said Letters Patent is hereby corrected as shown below:

Column 5,
Line 7, after "block", replace "16b" by --6b--;
Line 8, after "block", replace "16a" by --6a--;
Line 26, after "peeled", replace "of f" by --off--;

Column 7,
Line 47, replace "first," by --first--;

Column 8,
Line 27, after "knife-edged", replace "shade" by --shape--;
Line 56, after "loading a", replace "photoelectroinagnetic" by --photoelectromagnetic--;
Line 58, after "attaching a", replace "hook-and loop" by --hook-and-loop--.

Signed and Sealed this

Sixth Day of January, 2009

JON W. DUDAS
*Director of the United States Patent and Trademark Office*